US006317574B1

(12) United States Patent
Shinohara et al.

(10) Patent No.: US 6,317,574 B1
(45) Date of Patent: Nov. 13, 2001

(54) CHARGING MEMBER, PROCESS CARTRIDGE, AND IMAGE FORMING APPARATUS

(75) Inventors: Seiichi Shinohara, Abiko; Junichi Kato, Kashiwa; Satoru Inami, Kashiwa; Atsutoshi Ando, Kashiwa; Yusuke Nakazono, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/510,341

(22) Filed: Feb. 22, 2000

(30) Foreign Application Priority Data

Feb. 25, 1999 (JP) ..... 11-049204
Aug. 27, 1999 (JP) ..... 11-242089

(51) Int. Cl.[7] ..... G03G 15/02
(52) U.S. Cl. ..... 399/176
(58) Field of Search ..... 399/168, 174, 399/176, 313; 361/225

(56) References Cited

U.S. PATENT DOCUMENTS 5,475,471 12/1995 Kisu et al. .
5,502,548 * 3/1996 Suzuki et al. ..... 399/110
5,543,899 8/1996 Inami et al. .
5,765,077 6/1998 Sakurai et al. ..... 399/176
5,790,927 8/1998 Ando et al. ..... 399/176
5,792,533 * 8/1998 Kurokawa et al. ..... 428/36.9
5,839,029 * 11/1998 Kataoka et al. ..... 399/115
6,020,054 * 2/2000 Masuda et al. ..... 428/319 C
6,067,430 * 5/2000 Mammino et al. ..... 399/174

FOREIGN PATENT DOCUMENTS 03-293682 * 12/1991 (JP) .
09-034156 * 2/1997 (JP) .
09-325571 * 12/1997 (JP) .
10-148995 6/1998 (JP) .
10-198127 * 7/1998 (JP) .
10-225969 * 8/1998 (JP) .

* cited by examiner

*Primary Examiner*—Robert Beatty
(74) *Attorney, Agent, or Firm*—Fitzpatrick, Cella, Harper & Scinto

(57) ABSTRACT

A charging member is disposed in contact with an electrophotographic photosensitive member and charges the surface of the electrophotographic photosensitive member electrostatically upon application of a voltage. The charging member has a conductive support, a base layer and a surface layer which are formed on the conductive support. The surface layer contains fluorine resin particles as a filler and a fluorine resin as a binder resin.

14 Claims, 4 Drawing Sheets

CHARGING MEMBER, PROCESS CARTRIDGE, AND IMAGE FORMING APPARATUS

BACKGROUND OF THE INVENTION

1. Field of the Invention

This invention relates to a charging member, a process cartridge and an image forming apparatus. More particularly, it relates to a charging member which is, in image forming apparatus such as copying machines and page printers, to be brought into contact with an electrophotographic photosensitive member to charge it electrostatically; and a process cartridge and an image forming apparatus which have such a charging member.

2. Related Background Art

As a charging means for primarily charging the electrophotographic photosensitive member serving as an image bearing member, corona charging assemblies, by which a high voltage is applied to a wire to cause corona discharge to take place and the photosensitive member, which is a member to be charged, is exposed to the corona thus produced, have conventionally been in wide use in electrophotographic image forming apparatus.

In recent years, a contact charging type charging means has also been developed and put into practical use, which is a charging means in which a charging member is so disposed as to be brought into contact with the photosensitive member and a voltage is applied to the charging member to charge the surface of the photosensitive member electrostatically.

This contact charging is in wide use because of its advantages that the applied voltage necessary for the photosensitive member to have the desired potential on its surface to be charged may be lower than that of the non-contact type corona charging and may generate ozone in a small quantity at the time of charging.

An example of a charging member in a conventional electrophotographic image forming apparatus is shown in FIG. 6.

A charging roller 2', which is the charging member, is constituted of a conductive support 21' serving also as a feeder electrode, an elastic layer 22' provided thereon, a resistance layer 23' further provided thereon and a protective layer 24' still further provided thereon.

The elastic layer 22' is formed of a synthetic rubber, where a solid rubber such as styrene-butadiene rubber (SBR), isoprene rubber or silicone rubber is used. These rubbers have been endowed with electrical conductivity by dispersing therein a conductive material such as carbon black or metal powder.

The resistance layer 23' is a layer for imparting an appropriate resistance to the charging roller 2', where polyamide resin, epichlorohydrin rubber, urethane rubber or silicone rubber is used. These materials have been endowed with an appropriate electrical conductivity by dispersing therein a conductive material such as carbon black or metal powder.

The protective layer 24' is provided in order to insure adequate surface performance of the charging roller 2' and in order to prevent the photosensitive member surface from being contaminated with the materials of the resistance layer 23'. Materials therefor may include polyamide resins such as N-methoxymethylated nylon, and urethane resins.

However, even when the photosensitive member surface is electrostatically charged by such contact charging, no uniform charging may be effected to cause faulty images due to uneven charging in some cases. This is because a developer (toner) adhering to the photosensitive member surface comes to adhere to the charging member though it is in a very small quantity, to cause uneven charging.

To solve such a problem, a method has been proposed in which the charging member is incorporated with fluorine resin particles in its surface portion (Japanese Patent Application Laid-Open No. 3-293682).

The above method, however, may cause a poor cleaning performance when the fluorine resin particles present at the surface of the charging member are mixed in a small quantity, especially in an environment of low temperature and low humidity, and hence may make the developer adhere to the charging member in a large quantity to cause uneven charging. Also, when the fluorine resin particles are mixed in a large quantity, it may be difficult to disperse the particles, so that film-forming properties may lower to cause cracks and peeling.

Japanese Patent Application Laid-Open No. 10-148995 discloses the concept of a method of incorporating fluorine resin in the protective layer. However, such fluorine resin not in the form of particles has a small effect on preventing uneven charging compared with that in the form of particles. Also, when it is incorporated in a large quantity so as to be effective, the protective layer may have a high releasability to have a low adhesion between it and its underlying layer. Especially where moisture condensation has occurred on the surfaces of the charging member and photosensitive member and their moisture-condensed surfaces have come into contact with each other, the water is confined at the contact nip between the charging member and the photosensitive member. This tends to cause a weld between the protective layer and the photosensitive member to cause "peeling" where only the protective layer of the charging member comes off partly, to remain on the surface of the photosensitive member.

SUMMARY OF THE INVENTION

An object of the present invention is to overcome the disadvantages as stated above and provide a charging member that can prevent any uneven charging from occurring when the toner on the photosensitive member surface adheres to the charging member, and also to prevent peeling; and to provide a process cartridge and an image forming apparatus which have such a charging member.

To achieve the above object, the present invention provides a charging member which is disposed in contact with an electrophotographic photosensitive member and charges the surface of the electrophotographic photosensitive member electrostatically upon application of a voltage; the charging member comprising a conductive support, and a base layer and a surface layer which are formed on the conductive support, the surface layer containing fluorine resin particles as a filler and a fluorine resin as a binder resin.

The present invention also provides a process cartridge comprising:

- an electrophotographic photosensitive member on which a visible image is to be formed upon charging, exposure and development; and
- a charging member which is disposed in contact with the electrophotographic photosensitive member and charges the surface of the electrophotographic photosensitive member electrostatically upon application of a voltage;
- the electrophotographic photosensitive member and the charging member being supported as one unit and being detachably mountable to the main body of an electrophotographic apparatus; and the charging member comprising a conductive support, and a base layer and a surface layer which are formed on the conductive support;

the surface layer containing fluorine resin particles as a filler and a fluorine resin as a binder resin.

The present invention still also provides an image forming apparatus comprising:

an electrophotographic photosensitive member; and a charging member which is disposed in contact with the electrophotographic photosensitive member and charges the surface of the electrophotographic photosensitive member electrostatically upon application of a voltage;

the charging member comprising a conductive support, and a base layer and a surface layer which are formed on the conductive support;

the surface layer containing fluorine resin particles as a filler and a fluorine resin as a binder resin.

DESCRIPTION OF THE PREFERRED EMBODIMENTS

Figure 1:
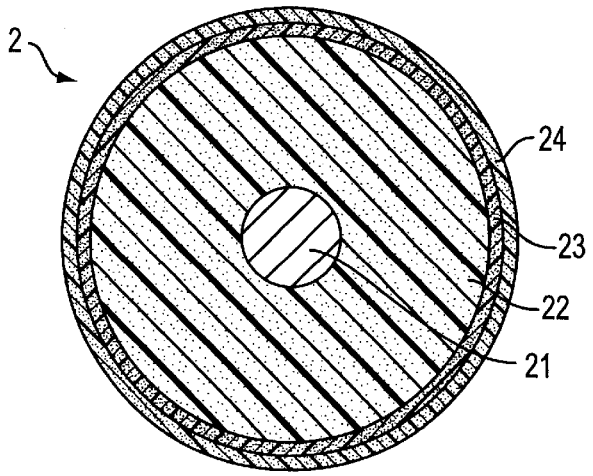
FIG. 1 illustrates the construction of a charging member of the present invention.

The charging member of the present invention is disposed in contact with an electrophotographic photosensitive member and charges the surface of the electrophotographic photosensitive member electrostatically upon application of a voltage, and comprises a conductive support, and a base layer and a surface layer which are formed on the conductive support. The surface layer contains fluorine resin particles as a filler and a fluorine resin as a binder resin.

The fluorine resin particles as a filler in the present invention are substantially not compatible with the fluorine resin as a binder resin and stand in the form of particles in the binder resin. Such particles may have an average particle diameter of not more than 1 $\mu$m, and particularly preferably not more than 0.5 $\mu$m. Those having an average particle diameter larger than 1 $\mu$m tends to decrease dispersibility and to cause cracks. The average particle diameter is defined as 50% of the diameter of the cumulative percentage of the volume-based particle diameter distribution by means of the Coulter Counter method.

The fluorine resin particles as a filler and the fluorine resin as a binder resin may preferably have a content of from 50 to 95% by weight as the total contents based on the total weight of the surface layer. If it has a content less than 50% by weight, faulty charging due to toner adhesion tends to be caused. If it has a content more than 95% by weight, cracks and peeling tend to be caused by decreasing the film-forming property. Incidentally, as a material usable in combination with these fillers and binder resins, it may include resins such as ester resins or vinyl resins, synthetic rubbers such as NBR (acrylonitrilbutadien rubber), and natural rubbers.

The fluorine resin particles as a filler and the fluorine resin as a binder resin may preferably be in a proportion of from 1:1 to 1:2 as a weight ratio (fluorine resin particles:fluorine resin). If the fluorine resin particles are in too small a quantity, faulty charging due to toner adhesion tends to be caused. If they are in too a large quantity, the cracks and peeling tends to be caused by decreasing the film-forming property.

In the present invention, the surface layer may preferably further contain a positively chargeable material for the purpose of preventing faulty images (horizontal lines) in initial-stage image reproduction, which are caused when the photosensitive member holds the memory of a positive potential. Such a memory of the positive potential on the photosensitive member is considered to be due to the high negative chargeability of the fluorine resin materials, and is caused by the rubbing between the charging member and the photosensitive member by means of great impact during, e.g., transportation for market distribution. This memory tends to occur especially in an environment of low humidity.

The positively chargeable material refers to a material that position a plus side more than the photosensitive member in electrification series and is positively chargeable upon the rubbing between it and the photosensitive member. The positively chargeable material may preferably be contained in an amount of from 1 to 15% by weight, and particularly preferably from 5 to 10% by weight, based on the total weight of the surface layer. If it is less than 1% by weight, the effect of preventing faulty image may be attained with difficulty. If it is more than 15% by weight, the effects of the fluorine resin particles as a filler and the fluorine resin as a binder resin may be attained with difficulty.

The present invention will be described below in detail by giving Examples.

EXAMPLE 1

An example of the image forming apparatus according to the present invention will be described here. FIG. 1 is a cross-sectional view showing the construction of a charging member used in the present example.

As shown in FIG. 1, the charging member in the present example is a roller-shaped charging member, i.e., a charging roller 2. The charging roller 2 comprises a metallic or plastic conductive support 21 serving also as a feeder electrode, and provided around it are an elastic layer 22, a resistance layer 23, and a protective layer 24 as a surface layer in this order. It has an outer diameter of about 12 mm.

The elastic layer 22 serves as the base layer of the charging roller 2. In the present example, it was formed of a urethane foam, and a metal oxide was added to make it have a conductivity. It was in a thickness of about 1.7 mm.

The resistance layer 23 was formed on the elastic layer by dip-coating an aqueous acrylic resin having carbon black added thereto. The resistance layer was formed in a thickness of about 300 $\mu$m, by natural drying for 5 to 6 hours in an environment of 100° C. after the coating.

The protective layer 24 serves as the surface layer, and was formed by coating a mixture prepared by adding fluorine resin particles, having an average particle diameter of 0.4 $\mu$m, and carbon as fillers, to a binder resin comprised of fluorine resin, ester resin and acrylic resin as the positively chargeable material, which was formed on the resistance layer 23 by dip-coating, followed by drying. Here, for the fluorine resin used as a binder resin, PCTF (polychlorotrifluoroethylene) was used. For the acrylic resin, an emulsion type one was used which was comprised of a copolymer of ethyl acrylate, methyl acrylate, butyl acrylate, styrene and acrylonitrile. For the fluorine resin particles used as a filler, PTFE (polytetrafluoroethylene) was used. The protective layer was formed in a thickness of about 10 $\mu$m. The fluorine resin particles, the carbon, the fluorine resin, the ester resin and the acrylic resin were in a proportion of 35:5:45:5:10 as the weight ratio.

EXAMPLE 2

A charging roller was produced in the same manner as in Example 1 except that the protective layer was formed using a binder resin comprised of only the fluorine resin and the ester resin, and fluorine resin particles and carbon as fillers (formulation without the acrylic resin). The fluorine resin particles, the carbon, the fluorine resin, the ester resin and the acrylic resin are in a proportion of 35:5:45:15:0 as the weight ratio.

As comparative examples, the following charging members were also prepared.

Comparative Example 1

A charging roller was produced in the same manner as in Example 1 except that the protective layer was formed using a binder resin comprised of the fluorine resin, the ester resin and the acrylic resin, and only carbon as a filler (formulation without the fluorine resin particles). The fluorine resin particles, carbon, the fluorine resin, ester resin and acrylic resin was in a proportion of 0:5:80:5:10 as weight ratio.

Comparative Example 2

A charging roller was produced in the same manner as in Example 1 except that the protective layer was formed using a binder resin comprised of only the fluorine resin and the ester resin, and only carbon as a filler (formulation without the acrylic resin and the fluorine resin particles). The fluorine resin particles, the carbon, the fluorine resin, the ester resin and the acrylic resin were in a proportion of 0:5:80:15:0 as the weight ratio.

Comparative Example 3

A charging roller was produced in the same manner as in Example 1 except that the protective layer was formed using a binder resin comprised of only the ester resin and the acrylic resin, and fluorine resin particles and carbon as fillers (formulation without the fluorine resin). The fluorine resin particles, the carbon, the fluorine resin, the ester resin and the acrylic resin were in a proportion of 80:5:0:5:10 as the weight ratio.

Comparative Example 4

A charging roller was produced in the same manner as in Example 1 except that the protective layer was formed using a binder resin comprised of only the ester resin, and fluorine resin particles and carbon as fillers (formulation without the fluorine resin and the acrylic resin). The fluorine resin particles, the carbon, the fluorine resin, the ester resin and the acrylic resin were in a proportion of 80:5:0:15:0 as the weight ratio.

Comparative Example 5

A charging roller was produced in the same manner as in Example 1 except that the protective layer was formed using a binder resin comprised of only the ester resin, and only carbon as a filler (formulation without the fluorine resin, the acrylic resin and the fluorine resin particles). The fluorine resin particles, the carbon, the fluorine resin, the ester resin and the acrylic resin were in a proportion of 0:5:0:95:0 as the weight ratio.

Figure 2:
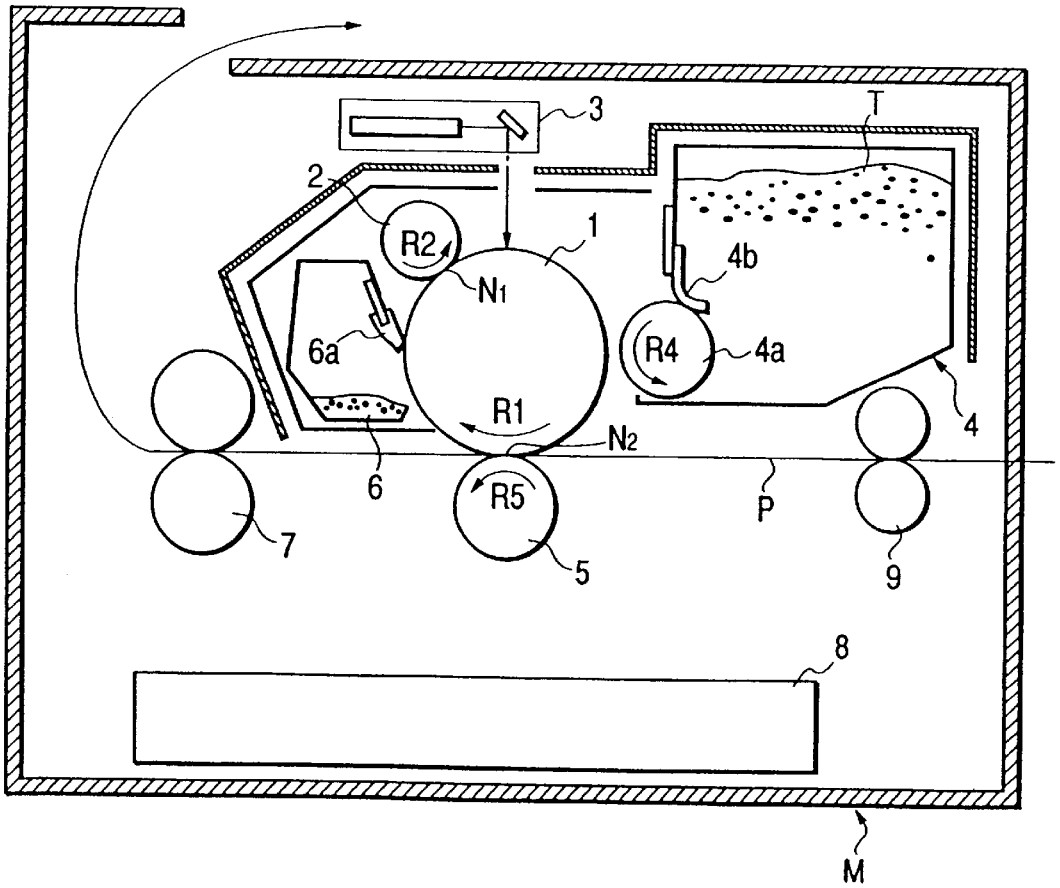
FIG. 2 is a schematic cross-sectional view of an image forming apparatus in Example 1 and comparative Examples 1 and 3.

FIG. 2 is a schematic cross-sectional view of a laser printer image forming apparatus used in the present examples.

In FIG. 2, M denotes the image forming apparatus main body as a printer engine. Reference numeral 1 denotes a cylindrical electrophotographic photosensitive member (photosensitive drum) as an image bearing member, and is driven rotatingly in the direction of an arrow R1 by a driving means (not shown). The photosensitive drum 1 is so disposed that its surface comes into contact with a charging roller 2 to form a charging nip N1. Also, its surface is uniformly electrostatically charged by the charging roller 2 rotated in the direction of an arrow R2. Thereafter, an electrostatic latent image is formed on the drum surface by means of an exposure assembly 3.

A developing assembly (a toner image forming means) 4 has a hopper which is a toner holder for storing or keeping a toner T and a developing sleeve 4*a* which is a toner carrying member, and develops the electrostatic latent image formed on the photosensitive drum 1. In the vicinity of the developing sleeve 4*a*, rotated in the direction of an arrow R4, a developing blade 4*b* is provided which is a toner regulation member.

Then, a development bias formed by superimposing an AC bias on a DC bias is applied across the photosensitive drum 1 and the developing sleeve 4*a* through an engine control unit 8 having a power source for driving the image forming apparatus and a high-pressure circuit which feeds a bias for forming images. Thus, the electrostatic latent image formed on the photosensitive drum 1, to which image the toner is made to adhere, is developed as a toner image.

The toner image on the photosensitive drum 1 is transferred to a transfer material P such as paper by a transfer assembly (a transfer means) 5 rotated in the direction of an arrow R5. The transfer material P is kept in a paper feed cassette (not shown), fed by means of a feed roller (not shown), and forwarded to a transfer nip N2 between the photosensitive drum 1 and the transfer assembly 5 by means of a resist roller 9 and in synchronization with the toner image formed on the photosensitive drum 1. The toner image transferred to the transfer material P is transported to a fixing assembly 7 together with the transfer material P, and is heated and pressed there so as to be fixed to the transfer material P to become a recorded image.

Meanwhile, the toner remaining on the photosensitive drum 1 after the transfer of the toner image without being transferred to the transfer material P (hereinafter "transfer residual toner") is removed by a cleaning blade 6*a* provided in a cleaning assembly (a cleaning means) 6. The photosensitive drum 1 from which the transfer residual toner has been removed is brought to the next image formation that begins from the charging by the charging assembly 2, and the above process of image formation is repeated.

Now, the charging rollers produced as described above were each set in the image forming apparatus shown in FIG. 2 to make a vibration test. Thereafter, an image reproduction test was made on 2,000 sheets to form A4 size images with a print percentage (image area percentage) of 4%, in a low-temperature and low-humidity environment of 15.0° C. temperature/10.0% humidity (hereinafter "L/L environment") and a normal-temperature and normal-humidity environment of 23.5° C. temperature/60.0% humidity (hereinafter "N/N environment"). Evaluation was made visually on whether or not any memory-by-rubbing and faulty charging occurred on the photosensitive member.

The vibration test was made according to JIS Z0232, under conditions of frequency (number of vibration): 10 to 100 Hz; sweep time: 5 minutes (one round); acceleration: sinusoidal wave 9.8 $m/s^2$; vibration time: 1 hour (12 rounds); and vibration directions: x, y and z directions. Evaluation was also made on any peeling of the protective layer by examining the charging roller surface and the photosensitive drum surface after the charging roller was brought into contact with the photosensitive drum under application of a load of 1,400 g and these were left for a month in an environment of temperature and humidity of 40° C./95%.

Table 1 shows the results of the above evaluation. In Table 1, with regard to the results of evaluation on memory-by-rubbing, a case where, in halftone images formed in initial-stage image reproduction in the L/L environment after the vibration test, any horizontal lines due to memory-by-rubbing did not appear was evaluated as "A"; a case where they appeared a little but in a density low enough to be on a level not problematic, was denoted as "B"; and a case where distinct horizontal lines appeared over the whole lengthwise area, was denoted as "C".

With regard to the results of evaluation on uneven charging (faulty charging), a case where any faulty images due to uneven charging did not appear throughout the image reproduction of 2,000 sheets in both the L/L environment and the N/N environment was evaluated as "A"; a case where they appeared but so slightly as to be on a level not problematic, was denoted as "B"; and a case where they appeared beyond tolerance limits, was denoted as "C".

With regard to the results of evaluation on peeling, a case where there was no problem on both the charging roller surface and the photosensitive member surface in the above method of evaluation on peeling was evaluated as "A"; and a case where marks of peeling were seen on the charging roller surface and peel fragments stood adhered to the photosensitive member surface, was denoted as "C".

As can be seen from Table 1, in Example 1, in which the protective layer was formulated using the filler constituted of fluorine resin particles and carbon and the binder resin constituted of fluorine resin, ester resin and acrylic resin, any horizontal lines due to memory-by-rubbing did not appear and also any faulty images due to uneven charging did not appear, in both the L/L environment and the N/N environment until the 2,000 sheet running was completed.

However, in Example 2, in which the filler was constituted of fluorine resin particles and carbon and the binder resin was constituted of only fluorine resin and ester resin (formulation without the acrylic resin), any faulty images due to uneven charging did not appear in both the L/L environment and the N/N environment but horizontal lines due to memory-by-rubbing appeared.

In Comparative Example 1, in which the filler was constituted of only carbon and the binder resin was constituted of fluorine resin, ester resin and acrylic resin (formulation without the fluorine resin particles), any uneven charging did not occur in the N/N environment but the uneven charging occurred beyond tolerance limits in the N/N environment before the running test was completed. In Comparative Example 2, corresponding to Comparative Example 1 from which the acrylic resin was removed, the memory-by-rubbing tended to occur a little seriously though it was within tolerance limits.

In Comparative Example 3, in which the filler was constituted of fluorine resin particles and carbon and the binder resin was constituted of only ester resin and acrylic resin (formulation without the fluorine resin), the uneven charging occurred on a slight level in the N/N environment but it occurred beyond tolerance limits in the L/L environment before the running test was completed. In Comparative Example 4, corresponding to Comparative Example 3 from which the acrylic resin was removed, the memory-by-rubbing tended to occur a little seriously though it was within tolerance limits.

In Comparative Example 5, in which the filler was constituted of only carbon and the binder resin was also constituted of only ester resin (formulation without the fluorine resin, the acrylic resin and the fluorine resin particles), the uneven charging occurred on a serious level in both the L/L environment and the N/N environment.

From the foregoing, it is considered that, in the formulation where the acrylic resin is not mixed, the photosensitive drum and the charging roller rub against each other in the initial-stage vibration test to cause the fluorine-resin-containing charging roller to be negatively charged, so that the photosensitive drum has induced positive electric charges, which remain as memory to cause the horizontal lines. On the other hand, the mixing of the positively chargeable material acrylic resin cancels the negatively chargeable fluorine resin potentially to make it hard for the charging roller to become charged by rubbing, and thus the horizontal lines due to memory can be prevented.

The mixing of fluorine resin materials different in form, (the fluorine resin particles and the fluorine resin) in the protective layer also has brought about surface film-forming properties and at the same time has brought about surface releasability effectively. The mixing of only the fluorine resin or only the fluorine resin particles is not effective for improving the surface releasability, or its mixing in a large quantity makes the protective layer have low film-forming properties, to cause its peeling.

Figure 3:
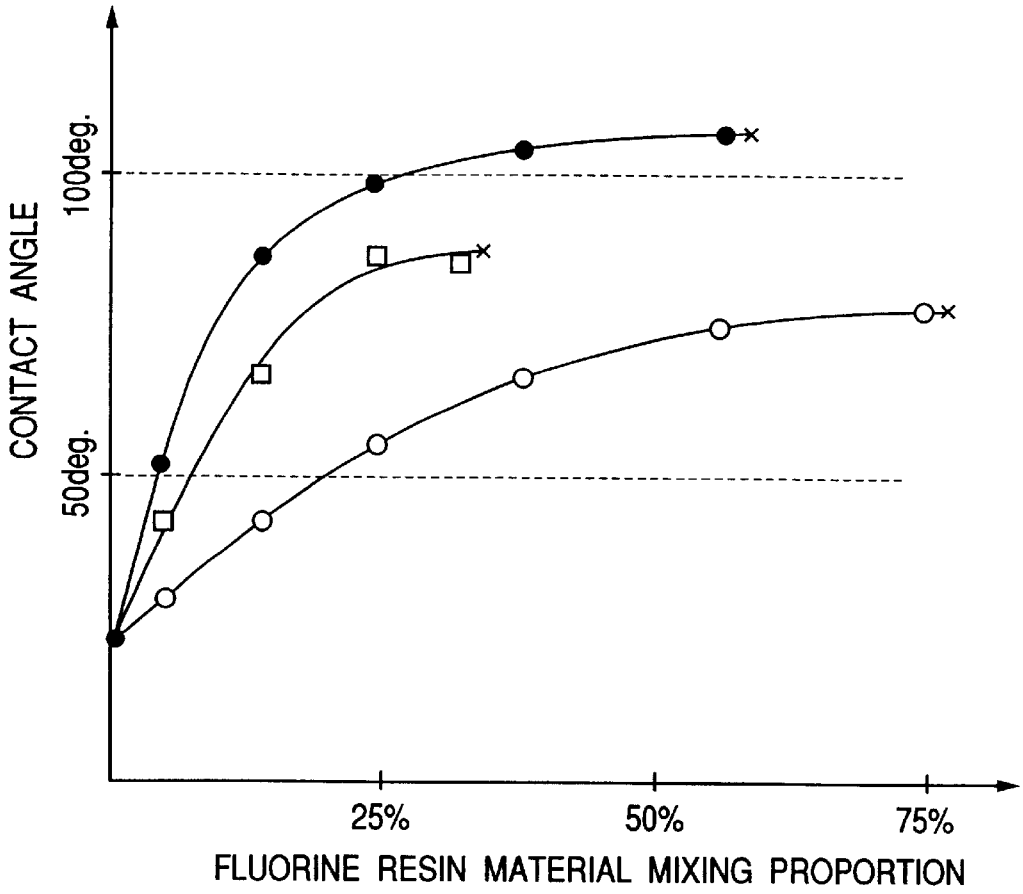
FIG. 3 is a graph showing the relationship between fluorine resin mixing ratios and contact angles in Example 1.

FIG. 3 is a graph showing contact angles of the charging roller surface to pure water and peeling limits (peel point: X) in instances where the mixing proportions of fluorine resin materials in the charging roller protective layers are changed with respect to the fluorine resin particles and fluorine resin in the formulation in Example 1 (black circles), the fluorine resin in the formulation in Comparative Example 1 (white circles) and the fluorine resin particles in the formulation in Comparative Example 3 (white squares).

To measure the contact angles as a means for observing releasability, a CA-X type contact angle meter manufactured by Kyowa Kaimen Kagaku K. K. was used, where the charging roller was made to naturally wet with 3.1 $\mu l$ of water drops at the middle and both ends in its lengthwise direction, and an average value of measurements at the three points was found. The mixing proportions of the respective fluorine resin materials were calculated as weight proportion in the whole materials that form the protective layer. Evaluation on peeling was made by the peeling evaluation method described above.

As can be seen from FIG. 3, in the formulation of Example 1, the contact angle comes to be 90 degrees when the fluorine resin particles and fluorine resin are in a mixing proportion of 12% by weight, and thereafter it shifts to contact angles of a little greater than 100 degrees until the peeling occurs when the mixing proportion is 60% by weight. In the formulation of Comparative Example 1, the peeling does not occur until the mixing proportion of the fluorine resin exceeds 75% by weight, but the contact angle shows a tendency to saturation at about 70 degrees. In the formulation of Comparative Example 3, the contact angle reaches a little smaller than 90 degrees, but the peeling occurs when the mixing proportion of fluorine resin particles reaches 35% by weight. These can be explained as follows:

The fluorine resin functions as a binder resin and hence acts favorably on the peeling. With respect to the contact angle (releasability), however, the fluorine resin is superior to any mere binder resin but inferior to the fluorine resin particles of PTFE or the like. On the other hand, the fluorine resin particles tend to cause peeling because of poor film-forming properties and their mixing in a large proportion makes it difficult for them to be dispersed uniformly. Hence, although a large contact angle (high releasability) can be attained locally, so large a contact angle (high releasability) can not be attained when viewed on the average of the whole, because of the influence by other materials. From these facts, it can be understood that the use of the fluorine resin particles as a filler and the use of the fluorine resin as a binder resin makes their individual use be in a low mixing proportion and hence can provide a large contact angle (high releasability) efficiently and also act favorably against the peeling. Also, in order to prevent uneven charging in the L/L environment until the running is completed, it is preferred that the fluorine resin particles and fluorine resin are used and the contact angle is 90 degrees or larger.

From the foregoing results, it can be said that good images can be obtained without causing any horizontal lines due to rubbing with the photosensitive member, without causing any uneven charging even in the L/L environment and also without causing any peeling of the surface layer when a charging roller is used whose protective layer surface layer contains at least the fluorine resin materials and the positively chargeable material and the fluorine resin materials are the fluorine resin particles as a filler and the fluorine resin as a binder resin. Also, as long as the contact angle on the surface of the charging roller is 90 degrees or larger, uneven charging does not occur until the running is completed, even in the L/L environment, causative of poor cleaning performance. Thus, such a contact angle is preferred.

In these examples, the acrylic resin comprising a copolymer of ethyl acrylate, methyl acrylate, butyl acrylate, styrene and acrylonitrile is used as the positively chargeable material, but is by no means limited thereto as long as the same effect can be obtained. Also usable are acrylic resins having different formulation, of course, and polyamide resins. In view of electrification series, acrylic resins are the most advantageous as the positively chargeable material and are preferred. Also, PTFE is used here as the filler fluorine resin particles, but PFA (tetrafluoroethylene-perfluoroalkylvinylether), FEP (fluoroethylene-propylene) and PCTFE may also be used, where the same effect as that can be obtained. In view of obtaining higher releasability, PTFE and PFA, particularly PTFE is preferred. With regard to the binder resin fluorine resin, PCTFE is used in these examples but the fluorine resin materials are different from the fluorine resin particles used as a filler to serve as a binder. For example, the fluorine resins having lower melting points are preferred. Such fluorine resins include FEP (fluorinated ethylene propylene), PVF (polyvinyl fluoride), PVDF (polyvinylidene fluoride), ETFE (ethylene-tetrafluoroethylene), and ECTFE (trifluorinated chlorinated ethylene-ethylene) in addition to PCTFE. In view of the fluorine resin particles used as a filler, it is preferable that the fluorine resin may be optionally selected from these materials. In view of superior film-forming property and releasability, PCTFE is preferred.

EXAMPLE 3

Figure 4:
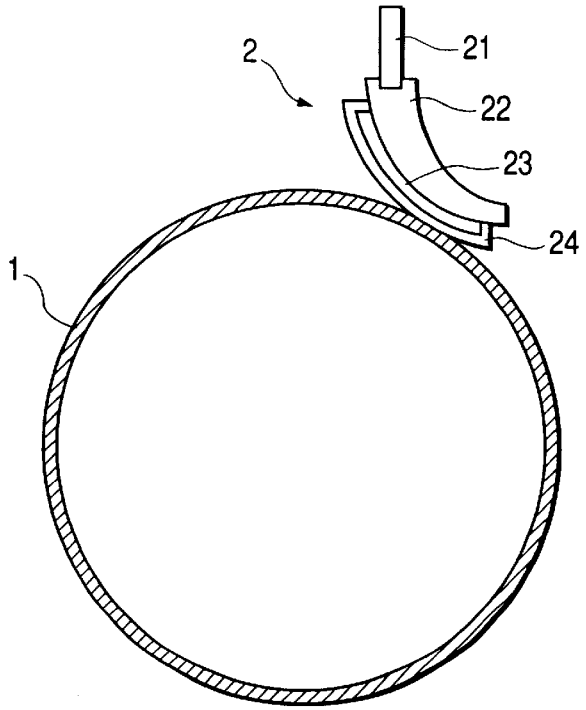
FIG. 4 illustrates the construction of a photosensitive drum and a charging blade in Examples 3 and 6.

In the present example, a blade type member as shown in FIG. 4 is used as the charging member 2.

This charging blade as the charging member 2 comprises a metallic or plastic conductive support 21 serving also as a feeder electrode, a urethane foam base material 22 supported on the support, a resistance layer 23 provided on the surface of the base material 21 on the side of a photosensitive drum 1, and as a surface layer a protective layer 24 which covers the resistance layer 23. Materials for the resistance layer 23 and protective layer 24 are the same as those for the resistance layer and protective layer, respectively, of the charging roller used as the charging member 2 in Example 1.

With regard to such a charging blade 20 as the charging member 2, the contact angle to pure water at its part coming into contact with the photosensitive drum 1 was measured, and a running test for examining faulty images was made in the L/L environment. As the result, like the result in Example 1, the horizontal lines due to memory-by-rubbing and the uneven charging were well preventable when a charging blade was used whose surface layer contains at least the fluorine resin materials and the positively chargeable material and the fluorine resin materials are the fluorine resin particles as a filler and the fluorine resin as a binder resin. Also, as long as the contact angle was 90 degrees or larger, the uneven charging did not occur until the running was completed, even in the L/L environment, causative of poor cleaning performance, and also any peeling of the surface layer did not occur.

In Examples 1, 2 and 3, the roller-shaped or blade-shaped member is used as the charging member 2. Without limitation to such shapes, any members may be used as long as they are charging members whose surface layers contain the fluorine resin particles as a filler and contains the fluorine resin as a binder. In view of charging uniformity, the roller-shaped member is preferred.

EXAMPLE 4

Figure 5:
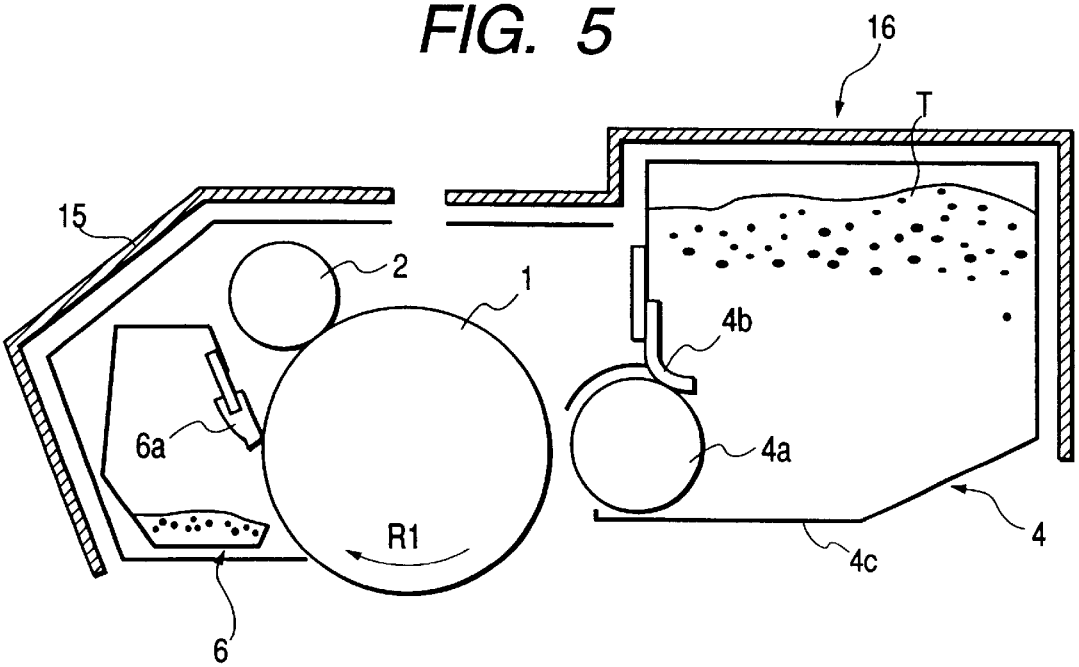
FIG. 5 illustrates the construction of a process cartridge of the present invention in Examples 4 and 7.
Figure 6:
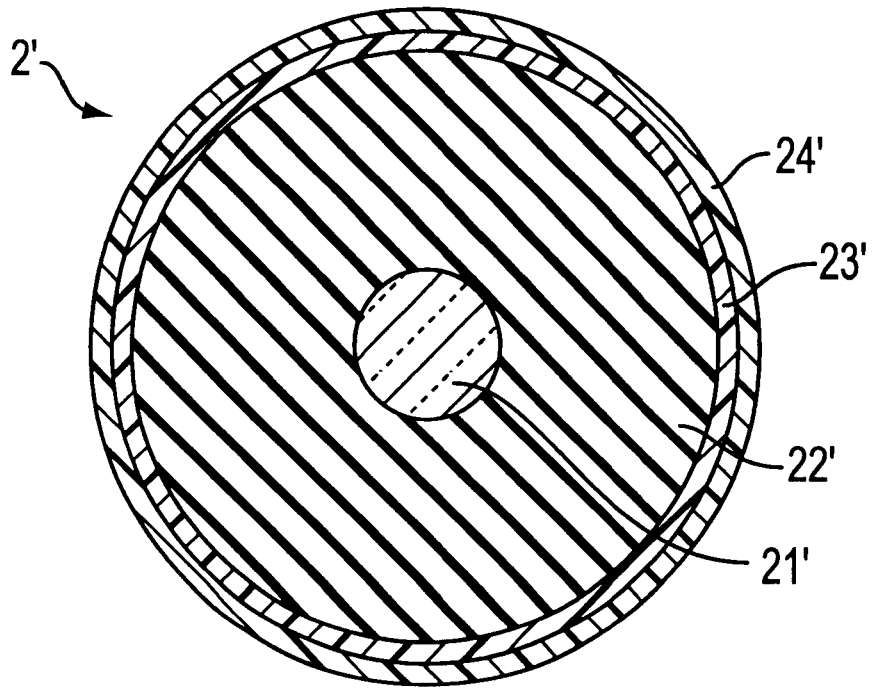
FIG. 6 (PRIOR ART)
FIG. 6 illustrates the construction of a charging member of the prior art.

FIG. 5 cross-sectionally illustrates a process cartridge according to the present invention.

What is characteristic in the present example is that the charging member 2 described in Example 1 is set as one unit in a cartridge casing 15 to set up a process cartridge detachably mountable to the main body of an image forming apparatus. In the process cartridge, 16, shown in FIG. 5, a photosensitive drum 1, the charging member 2, a developing means 4 and a cleaning means 6 are set as one unit to set up the process cartridge 16.

This process cartridge 16 is mounted to the main body of an image forming apparatus having a power source for driving the photosensitive drum 1 and so forth and a high-pressure circuit which feeds a bias for forming images, and a toner image is formed on the photosensitive drum 1.

The toner image formed on the photosensitive drum 1 is transferred to a transfer material P by means of a transfer assembly 5 (see FIG. 2) provided in the image forming apparatus main body, and is fixed by means of a fixing assembly 7. The transfer residual toner remaining on the photosensitive drum 1 without being transferred to the transfer material P is removed by the cleaning means 6 provided in the process cartridge 16.

Thus, there can be the effect that the faulty charging can well be prevented as in the case of Example 1 described previously, and it becomes possible to provide a maintenance-free process cartridge.

EXAMPLE 5

Comparative Examples 6 to 8

Charging members were produced in the same manner as in Example 1, Comparative Example 4, Comparative Example 5 and Comparative Example 3, respectively, except that the acrylic resin was not used. The charging members thus obtained were evaluated in the same manner as in Example 1 except that the vibration test and the evaluation on memory-by-rubbing were not made and the contact angle was measured in the manner as described previously.

Results obtained are shown in Table 2.

As can be seen from Table 2, in Example 1, in which the protective layer was formulated using the filler constituted of fluorine resin particles and carbon and the binder resin constituted of fluorine resin and ester resin, any faulty images due to uneven charging did not appear in both the L/L environment and the N/N environment until the 2,000-sheet running test was completed. In Comparative Example 6, however, in which the filler was constituted of fluorine resin particles and carbon and the binder resin was constituted of only ester resin, any faulty images due to uneven charging did not appear in the N/N environment but the uneven charging occurred beyond tolerance limits in the L/L environment just before the 2,000-sheet running test was completed. Also, in Comparative Example 7, in which the filler was constituted of only carbon and the binder resin was constituted of fluorine resin and ester resin, the uneven charging occurred in the N/N environment only on a slight level, but the uneven charging occurred beyond tolerance limits in the L/L environment before the running test was completed. Still also, in Comparative Example 8, in which the filler was constituted of only carbon and the binder resin was also constituted of only ester resin, the uneven charging occurred seriously in both the L/L environment and the N/N environment.

As for the contact angle, better results are obtained with respect to the uneven charging, the larger the contact angles are. This suggests that the both correlate with each other.

Accordingly, in the formulation for the protective layer in Example 5, the mixing proportions of the filler fluorine resin particles and binder resin fluorine resin were controlled. Using the charging members obtained, 2000-sheet running tests were made to make evaluation on uneven charging, and their contact angles were also measured. As the result, in the formulation for the protective layer in Example 5, the uneven charging was controllable to a level not problematic, in the L/L environment as along as the contact angle was 80 degrees or larger. As long as the contact angle was 90 degrees or larger, the uneven charging did not occur until the running was completed.

This is attributable to the contact angle to pure water being 80 degrees or larger, which makes extremely small the interfacial stress acting at the contact interface between the charging roller surface and the foreign matter such as toner, making it possible to prevent foreign matter such as toner from adhering, so that always uniform charging can be attained.

With regard to the peeling of the protective layer, the peeling did not occur at all.

Meanwhile, in the formulation for the protective layer in Comparative Examples 6 and 7, the mixing proportion of the fluorine resin particles or fluorine resin was made larger in order to make the contact angle not smaller than 80 degrees. In such cases, in Comparative Example 6, it was difficult to form protective layers. Also, in Comparative Example 7, the contact angle became 80 degrees or larger by making the mixing proportion larger, but, in the evaluation on peeling which was made by the evaluation method described previously, the peeling of the protective layer occurred and any desired charging roller was not obtainable.

On the foregoing, the same mechanism as noted previously is considered, which is as follows: The fluorine resin particles as a filler are greatly attributable to the releasability and the fluorine resin as a binder resin is attributable to both the releasability and the film forming properties. Hence, even though in the formulation for the protective layer in Example 4 the fluorine resin particles as a filler and the fluorine resin as a binder resin are in a small mixing proportion, their mutual cooperative effect enabled achievement of a high releasability and a large contact angle. Also, because of their small mixing proportion, the peeling of the surface layer did not occur. In Comparative Example 6, however, the fluorine resin particles had to be mixed in a large quantity in order to make the contact angle larger, so that the proportion of the filler became large with respect to the binder resin to make it difficult to form the protective layer. In Comparative Example 7, too, the fluorine resin had to be mixed in a large quantity in order to make the contact angle larger, so that the protective layer had a low adhesion to the underlying layer to have caused its peeling.

From the foregoing results, it can be said that good images can be obtained without causing any uneven charging even in the L/L environment and also without causing any peeling of the surface layer when a charging roller is used whose protective layer surface layer contains at least the fluorine resin materials as a filler and the fluorine resin as a binder resin.

The contact angle on the surface of the charging roller may preferably be 80 degrees or larger, and more preferably 90 degrees or larger, where the uneven charging does not occur until the running is completed, even in the L/L environment, causative of poor cleaning performance. Thus, such a contact angle is preferred.

In the present example, PTFE is used as the filler fluorine resin particles, but PFA may also be used, where the same effect as that can be obtained. With regard to the binder resin fluorine resin, PCTFE is used in the present example but is by no means limited thereto, and fluorine resins which can serve as a binder and therefore have melting points lower than PTFE and PFA may also be used, as exemplified by FEP, PVF, PVDF, ETFE and ECTFE.

EXAMPLE 6

In the present example, a blade type member as shown in FIG. 4 is used as the charging member 2 used in Example 5.

This charging blade as the charging member 2 comprises a metallic or plastic conductive support 21 serving also as a feeder electrode, a urethane foam base material 22 supported on the support, a resistance layer 23 provided on the surface of the base material 21 on the side of a photosensitive drum 1, and as a surface layer a protective layer 24 which covers the resistance layer 23. Materials for the resistance layer 23 and protective layer 24 are the same as those for the resistance layer and protective layer, respectively, of the charging roller used as the charging member 2 in Example 1.

With regard to such a charging blade 20 as the charging member 2, the contact angle to pure water at its part coming into contact with the photosensitive drum 1 was measured, and a running test for examining faulty images was made in the L/L environment. As a result, like the result in Example 1, the uneven charging was well preventable when the charging blade was used whose protective layer surface layer contains the fluorine resin particles as a filler and the fluorine resin as a binder resin. Also, as long as the contact angle was 90 degrees or larger, the uneven charging did not occur until the running is completed, even in the L/L environment, causative of poor cleaning performance, and also any peeling of the surface layer did not occur.

EXAMPLE 7

FIG. 5 cross-sectionally illustrates a process cartridge according to the present invention.

What is characteristic in the present example is that the charging member 2 described in Example 5 is set as one unit in a cartridge casing 15 to set up a process cartridge detachably mountable to the main body of an image forming apparatus. In the process cartridge, 16, shown in FIG. 5, a photosensitive drum 1, the charging member 2, a developing means 4 and a cleaning means 6 are set as one unit to set up the process cartridge 16.

This process cartridge 16 is mounted to the main body of an image forming apparatus having a power source for driving the photosensitive drum 1 and so forth and a high-pressure circuit which feeds a bias for forming images, and a toner image is formed on the photosensitive drum 1.

The toner image formed on the photosensitive drum 1 is transferred to a transfer material P by means of a transfer assembly 5 (see FIG. 2) provided in the image forming apparatus main body, and is fixed by means of a fixing assembly 7. The transfer residual toner remaining on the photosensitive drum 1 without being transferred to the transfer material P is removed by the cleaning means 6 provided in the process cartridge 16.

Thus, there can be the effect that the faulty charging can well be prevented as in the case of Example 1 described previously, and it becomes possible to provide an almost maintenance-free process cartridge.

TABLE 1

| | Formulation of protective layer | | Memory-by = rubbing | Uneven charging | | |
|---|---|---|---|---|---|---|
| | Filler | Binder resin | (L/L) | L/L | N/N | Peeling |
| Example 1 | fluorine resin particles + carbon | fluorine resin + ester resin + acrylic resin | A | A | A | A |
| Example 2 | fluorine resin particles + carbon | fluorine resin + ester resin | C | A | A | A |
| Comparative Example 1 | carbon | fluorine resin + ester resin + acrylic resin | A | C | B | A |
| Comparative Example 2 | carbon | fluorine resin + ester resin | B | C | B | A |
| Comparative Example 3 | fluorine resin particles + carbon | ester resin + acrylic resin | A | C | A | C |
| Comparative Example 4 | fluorine resin particles + carbon | ester resin | B | C | A | C |
| Comparative Example 5 | carbon | ester resin | A | C | C | A |

TABLE 2

| | Formulation of protective layer | | Uneven charging | | Contact angle |
|---|---|---|---|---|---|
| | Filler | Binder resin | L/L | N/N | (degrees) |
| Example 5 | fluorine resin particles + carbon | fluorine resin + ester resin | A | A | 98 |
| Comparative Example 6 | fluorine resin particles + carbon | ester resin | C | A | 76 |
| Comparative Example 7 | carbon | fluorine resin + ester resin | C | B | 74 |
| Comparative Example 8 | carbon | ester resin | C | C | 49 |

What is claimed is:

1. A charging member which is disposed in contact with an electrophotographic photosensitive member and charges the surface of the electrophotographic photosensitive member electrostatically upon application of a voltages, the charging member comprising:

a conductive support; and a base layer and a surface layer which are formed on the conductive support, said surface layer containing fluorine resin particles as a filler and a fluorine resin as a binder resin.

2. The charging member according to claim 1, wherein said fluorine resin particles as a filler is at least one of polytetrafluoroethylene and polytetrafluoroethylene-perfluoroalkylvinylether.

3. The charging member according to claim 1 or 2, wherein said fluorine resin as a binder resin is a resin different from the fluorine resin constituting the fluorine resin particles as a filler.

4. The charging member according to claim 3, wherein said fluorine resin as a binder resin is selected from the group consisting of polychlorotrifluoroethylene, fluorinated ethylene propylene, polyvinyl fluoride, polyvinylidene fluoride, ethylene-tetrafluoroethylene and trifluorinated chlorinated ethylene-ethylene.

5. The charging member according to claim 1, wherein said fluorine resin particles as a filler have an average particle diameter of not more than 1 $\mu$m.

6. The charging member according to claim 5, wherein said average particle diameter of the fluorine resin particles is not more than 0.5 $\mu$m.

7. The charging member according to claim 1, wherein said fluorine resin particles as a filler and said fluorine resin as a binder resin are contained in an amount of from 50% by weight to 95% by weight in total, based on the total weight of the surface layer.

8. The charging member according to claim 1 or 7, wherein the proportion of said fluorine resin particles as a filler and said fluorine resin as a binder resin is 1:1 to 1:2 as a weight proportion.

9. The charging member according to claim 1, wherein said surface layer further contains a positively chargeable material.

10. The charging member according to claim 9, wherein said positively chargeable material is an acrylic resin.

11. The charging member according to claim 1, wherein said surface layer has a contact angle to pure water of 80 degrees or larger.

12. The charging member according to claim 11, wherein said contact angle is 90 degrees or larger.

13. A process cartridge comprising:

an electrophotographic photosensitive member on which a visible image is to be formed upon charging, exposure and development; and a charging member which is disposed in contact with the electrophotographic photosensitive member and charges the surface of the electrophotographic photosensitive member electrostatically upon application of a voltage, said electrophotographic photosensitive member and said charging member being supported as one unit and being detachably mountable to the main body of an image forming apparatus, and said charging member comprising a conductive support, and a base layer and a surface layer which are formed on the conductive support, said surface layer containing fluorine resin particles as a filler and a fluorine resin as a binder resin.

14. An image forming apparatus comprising:

an electrophotographic photosensitive member; and a charging member which is disposed in contact with the electrophotographic photosensitive member and charges the surface of the electrophotographic photosensitive member electrostatically upon application of a voltage, said charging member comprising a conductive support, and a base layer and a surface layer which are formed on the conductive support, said surface layer containing fluorine resin particles as a filler and a fluorine resin as a binder resin.

* * * * *

UNITED STATES PATENT AND TRADEMARK OFFICE

CERTIFICATE OF CORRECTION

PATENT NO. : 6,317,574 B1
DATED : November 13, 2001
INVENTOR(S) : Seiichi Shinohara et al.

It is certified that error appears in the above-identified patent and that said Letters Patent is hereby corrected as shown below:

Column 2,
Line 51, “and” should be deleted.

Column 3,
Lines 4 and 18, “and” (1st occurrence) should be deleted.
Lines 5 and 19, “support;” should read -- support, --.
Line 45, “and” (2nd occurrence) should be deleted.
Line 55, “tends” should read -- tend --.

Column 4,
Line 12, “tends” should read -- tend --.
Line 27, “position” should read -- positions --.

Column 5,
Line 21, “are” should read -- were --.
Line 34, “was” should read -- were --.

Column 8,
Line 56, “proportion” should read -- proportions --.

Column 9,
Line 2, “saturation” should read -- saturate --.
Line 18, “can not” should read -- cannot --.
Line 60, “is” should read -- are --.

Column 10,
Line 48, “contains” should read -- contain --.

Column 11,
Line 19, “Comparative Examples” should read -- & COMPARATIVE EXAMPLES --.
Line 65, “make evaluation on” should read -- evaluate --.

Column 12,
Line 29, “On” should read -- In --.

Column 13,
Line 58, “is” should read -- was --.

UNITED STATES PATENT AND TRADEMARK OFFICE

CERTIFICATE OF CORRECTION

PATENT NO. : 6,317,574 B1
DATED : November 13, 2001
INVENTOR(S) : Seiichi Shinohara et al.

It is certified that error appears in the above-identified patent and that said Letters Patent is hereby corrected as shown below:

Column 15,
Line 5, "voltages," should read -- voltage, --.
Line 13, "is" should read -- was --.

Column 16,
Lines 25 and 37, "and" (1st occurrence) should be deleted.

Signed and Sealed this

Twenty-fourth Day of June, 2003

JAMES E. ROGAN
*Director of the United States Patent and Trademark Office*